United States Patent [19]

Ball

[11] Patent Number: 4,579,128

[45] Date of Patent: Apr. 1, 1986

[54] SMOKER'S PIPE

[76] Inventor: David Ball, 3 Meadow Ter., Houghton-Le-Spring, Tyne & Wear, England

[21] Appl. No.: 587,502

[22] Filed: Mar. 8, 1984

[51] Int. Cl.[4] ..... A24F 1/08; A24F 1/10

[52] U.S. Cl. ..... 131/201; 131/225; 131/227

[58] Field of Search ..... 131/212.1, 225–227, 131/214, 222, 201, 205, 215.1

[56] References Cited

U.S. PATENT DOCUMENTS

| | | | |
|---|---|---|---|
| 942,688 | 12/1909 | Whitney | 131/227 |
| 948,634 | 2/1910 | Perry | 131/227 |
| 2,086,042 | 7/1937 | McLellan | 131/227 |
| 2,382,627 | 8/1945 | Giern | 131/226 |
| 2,421,337 | 5/1947 | Lavietes | 131/225 |
| 2,421,338 | 5/1947 | Lavietes | 131/225 |
| 2,548,297 | 4/1951 | Ferguson | 131/222 |

FOREIGN PATENT DOCUMENTS

| | | | |
|---|---|---|---|
| 592402 | 8/1925 | France | 131/227 |
| 1230401 | 5/1971 | United Kingdom | 131/225 |

*Primary Examiner*—V. Miller
*Assistant Examiner*—H. Macey
*Attorney, Agent, or Firm*—Larson and Taylor

[57] ABSTRACT

A smoker's pipe comprises a bowl portion having a tobacco-receiving cavity below which is formed a transverse, tapering socket. A passageway interconnects the cavity with the socket. A tapering end portion of a stem part is a friction push-fit into the socket whereby the bowl portion can be rotated about the end portion of the stem part. The stem part includes a bore communicating directly with, and forming an extension of, the passageway. A primary reservoir in the lower regions of the bowl portion communicates with the bore and the passageway but is not in the direct path between the bore and the passageway, thereby keeping to a minimum the internal surface area of the pipe between the cavity and the bore. Thus the primary reservoir stores unwanted liquid in the pipe. Rotation of the bowl portion relative to the stem portion seals off the cavity from the reservoir and bore.

9 Claims, 2 Drawing Figures

SMOKER'S PIPE

BACKGROUND OF THE INVENTION

This invention relates to smoker's pipes and is particularly concerned with reducing the amount of undesirable moisture present in a pipe whilst maintaining a relatively cool smoke.

It is generally believed that saliva is the main cause of the unwanted liquid present in a smoker's pipe. However, this is not the case, a high proportion of this liquid resulting from the moisture present in the tobacco which turns into steam on burning of the tobacco and then condenses on impact with the cooler internal surfaces of the pipe as the smoke and steam are drawn through the pipe.

Smoker's pipes with briar bowls commonly include a reservoir in the lower regions of the bowl through which the smoke passes as it is drawn from the tobacco in the bowl along the stem of the pipe, said reservoir serving to store the unwanted liquid as it is formed, However, it will be appreciated that the provision of a reservoir in the passage of the smoke through the pipe increases the surface area with which the moisture—carrying smoke is in contact, with the result that more unwanted liquid is formed than would otherwise be the case.

Further, when it is desired to dispose of used tobacco ash from the bowl, it is conventional practice to turn the pipe upside down and tap out the contents from the bowl. This results in the liquid in the reservoir seeping back into the bowl and generally contaminating the bowl and its contents.

SUMMARY OF THE INVENTION

It is an object of the present invention to produce a smoker's pipe less prone to the formation of liquid than heretofore and furthermore which enables disposal of the bowl content without contamination of the bowl by any liquid present in the pipe.

According to the present invention there is provided a smoker's pipe comprising a bowl portion including a tobacco-receiving cavity and, extending transversely of the lower regions of said bowl portion below said cavity, a tapering socket, a passageway in the bowl portion interconnecting said cavity with said socket, the pipe further comprising a stem portion one end region of which is of tapering configuration to be a push-fit in the receiving socket of the bowl portion, the stem portion being provided with a bore extending from the other end thereof to terminate in the tapering surface of said one end region of the stem portion and communicating directly into, to form a continuation of, said passageway in the bowl portion, the lower regions of the bowl portion further including a primary reservoir into the upper regions of which said bore in the stem portion communicates, the bowl portion and stem portion being rotatable relative to one another about the longitudinal axis of the stem portion between a normal position in which the passageway in the bowl portion forms a continuation of the bore in the stem portion, and a displaced position in which said passageway is disconnected from said bore.

Conveniently the end extent of the bore within the tapered end region of the stem portion makes an acute angle with the longitudinal central axis of the stem portion and terminates in the upper surface of, intermediate the length of, said tapered end region.

The primary reservoir may be formed in the tapered end region of the stem portion inwardly of the end of the bore in the stem portion, a groove in the upper surface of said tapered end region of the stem portion interconnecting said bore with said primary reservoir.

Alternatively the primary reservoir may be formed in the socket of the bowl inwardly of the tapered end region of the stem portion, the end of said stem portion defining part of the bounding surface of the primary reservoir, a groove in the upper surface of the tapered end region of the stem portion interconnecting the bore of the stem portion with said primary reservoir.

In both cases, the bore in the stem portion may terminate in a secondary reservoir formed in the upper surface of the tapered end region of the stem portion and communicating directly with the passageway in the bowl portion, the groove in the upper surface of the tapered end region of the stem portion interconnecting said secondary reservoir with the primary reservoir.

The other, free end of the stem portion may be provided with an increased-strength insert surrounding the end extent of the bore.

One or more peripheral grooves may be formed in the external surface of the stem portion adjacent the bowl portion to improve a user's grip on the stem portion while rotating the bowl portion relative thereto.

Preferably the bowl portion of the pipe is of wood, such as briar or cherrywood, while at least the mouthpiece of the stem portion may be of, for example, a synthetic resin such as bakelite, or vulcanite. The tapered end region of the stem portion may be of a synthetic resin, wood or a metal such as stainless steel, while a series of peripheral external fins may be formed on that part of the stem portion adjacent the bowl portion to dissipate heat from the pipe.

DESCRIPTION OF THE PREFERRED EMBODIMENTS

Figure 1:
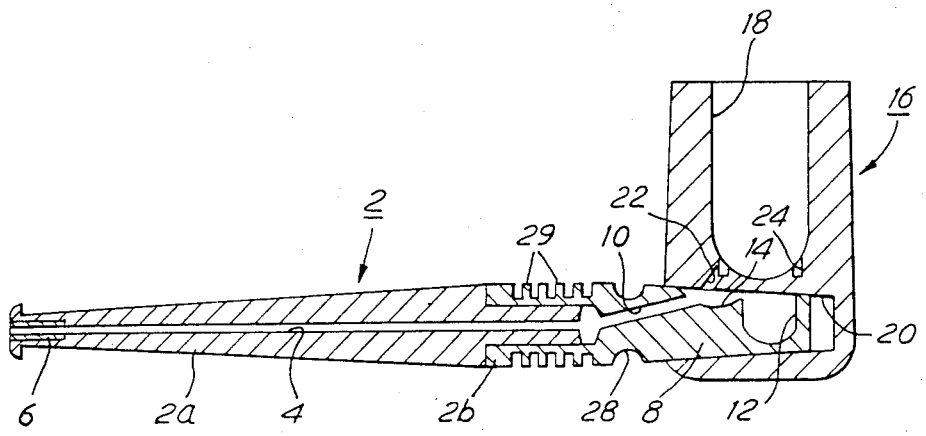
FIGS. 1 and 2 are longitudinal vertical sections through two alternative smoker's pipes according to the invention.

Referring to FIG. 1 of the drawings, the pipe comprises a stem portion indicated generally at 2 having a mouthpiece portion 2*a* of, for example, bakelite or vulcanite, and an inner end portion 2*b* which may be of vulcanite, bakelite, wood or a metal such as stainless steel. A central longituidinal bore 4 is formed in the stem portion 2. The mouthpiece portion 2*a* of the stem portion 2 may be provided with an increased-strength inset 6 of, for example, hard nylon or stainless steel, surrounding the end extent of the bore 4 whereby the smoker can bite into the stem portion 2 without biting right through the mouthpiece.

The inner end portion 2*b* of the stem portion 2 includes an extent 8 of generally tapering configuration in which a length 10 of the bore 4 is set at an acute angle to the main extent of said bore, the length 10 terminating in the tapering surface of said end extent 8 of the stem portion 2.

Between the end of the length 10 of the bore 4 and the inner end of the stem portion 2 there is formed, in said extent 8, a reservoir 12, a longitudinal groove 14 formed in the upper surface of the extent 8 of the stem portion 2 interconnecting the end of the bore 4, more particularly the end of the length 10 of said bore, with the reservoir 12.

The pipe further comprises a bowl portion indicated generally at 16 and conveniently of briar or cherrywood in which is formed a conventional tobacco-receiving cavity 18. A tapering socket 20 extends transversely of the lower regions of the bowl portion 16 below the cavity 18, the dimensions of said socket 20 corresponding with those of the end extent 8 of the stem portion 2 such that said extent 8 is a friction push-fit in the socket 20 and such that the stem portion 2 and bowl portion 16 can be rotated relative to one another about the central longitudinal axis of the stem portion 2.

A passageway 22 is formed in the bowl portion 16 to extend between the lower regions of the cavity 18 and the socket 20, said passageway terminating in the surface of the socket 20 at a point aligned with the end of the length 10 of the bore 4 in the stem portion 2, whereby said passageway 22 is in direct communication with, and forms an extension of, said bore 4 when the stem portion is in its normal position relative to the bowl portion as shown in FIG. 1.

An annular groove 24 is formed in the bowl portion 16 communicating into the lower regions of the cavity 18 and with the passageway 22 to improve the circulation of the smoke from the cavity 18 through the passageway 22 to the bore 4 in the stem portion 2.

In use of the pipe, moisture-containing tobacco is pressed into the cavity 18 and, after lighting, smoke and steam are drawn through the pipe from the cavity 18 along the passageway 22 and the bore 4 to the mouthpiece of the pipe.

It will be appreciated that the surface area of the interior of the pipe with which the smoke and steam make contact is kept to a minimum because of the substantially continuous nature of the passageway 22 and bore 4, there being no primary liquid-storing reservoir directly in the path of the smoke from the bowl portion 16 to the mouthpiece of the pipe as is the case in many conventional pipes.

What little liquid that results from condensation of the moisture from the tobacco is formed in the groove 14 and thence flows into, to be stored in, the reservoir 12.

Whereas with conventional pipes it is found necessary to dispose of the large volume of liquid formed during a smoke after each individual smoke, pipes according to the invention result in the formation of so little liquid that a number of smokes can be made before the reservoir 12 need be emptied. Further, the small amounts of liquid formed substantially eliminates the necessity for the provision of filter elements in the reservoir as are necessary in established pipes.

During smoking of a pipe, it is periodically necessary to dispose of the tobacco ash from the cavity 18 as the quantity of said ash increases. Normal practice is to turn the pipe upside down and tap the ash from the bowl portion 16. If there is juice or liquid contained in a reservoir of a pipe, it will be appreciated that, under normal circumstances, said liquid could return into and contaminate the bowl portion 16 on turning the pipe upside down.

In order to obviate this problem, and as mentioned above, the stem portion 2 can be rotated relative to the bowl portion 16. More particularly, prior to emptying ash from the cavity 18, the bowl portion 16 is rotated about the end extent 8 of the stem portion 2 until the end of the length 10 of the bore 4 and the groove 14 are disconnected from the passageway 22. In such a position, the reservoir 12, groove 14 and end of said length 10 of the bore 4 are covered by a continuous area of the wall defining the socket 20, whereby there is no passage from said volumes back into the cavity 18 of the bowl portion 16. Thus there is no possibility of any liquid in the stem portion 2 contaminating the bowl portion 16.

One or more peripheral grooves such as that shown at 28 are formed around the stem portion 2 adjacent the bowl portion 16 to improve the grip of a user on said stem portion 2 as the bowl portion 16 is being rotated prior to tapping out unwanted ash.

The provision of the angled extent 10 in the bore 4 serves a dual purpose in that it enables direct communication of the bore 4 with the passageway 22 and also raises the point of overflow from the groove 14 into the reservoir 12, effectively increasing the capacity of said reservoir. Further, the nature of the bore 4 enables ready passage therethrough of a pipe cleaner.

If desired, the narrow groove 14 could be increased in size somewhat into the form of a secondary reservoir, but of smaller size than that of the reservoir 12. However, it will be appreciated that the smaller the groove 14/ secondary reservoir, the less unwanted liquid will be formed on smoking of the pipe because the less will be the available cool surface area within the pipe to stimulate condensation of the steam in the smoke.

Thus, the internal configuration of the described pipe keeps the formation of undesirable liquid in the pipe to a minimum whilst still maintaining a cool smoke.

A series of axially-spaced, external peripheral fins 29 may be formed around the stem portion 2 outwardly of the grooves 28 to act as a radiator and to dissipate any heat from the pipe by increasing the surface area of the stem portion 2 adjacent the bowl portion 16.

Clearly the precise material of the stem portion 2 and bowl portion 16, as well as the locations and configuration of the internal passages and reservoir(s) within the pipe can be altered to suit particular requirements.

Figure 2:
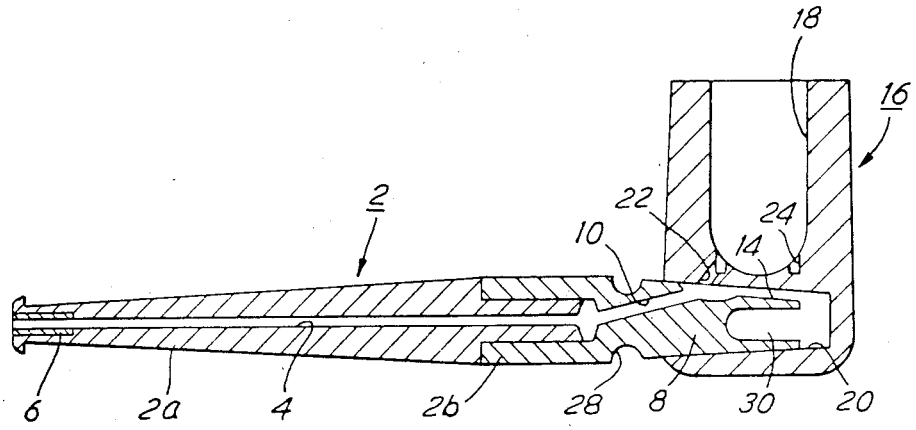

For example, referring to FIG. 2, in which parts equivalentto those of the pipe of FIG. 1 are similarly referenced, part of the primary reservoir is defined by the socket 20 in the lower regions of the bowl portion 16 rather than being entirely in the stem portion 2.

More particularly, the end of the extent 8 of the stem portion 2 has an axial cavity 30 formed therein which, together with the blind end of the socket 20, defines a primary reservoir in communication with the passageway 22 and the end of the length 10 of the bore 4 by means of a longitudinal groove 14 formed in the upper surface of the end extent 8 of the stem portion 2. Again, rotation of the bowl portion 16 about the stem portion 2 results in the primary reservoir, groove 14 and bore 4 being sealed from the cavity 18 in the bowl portion 16.

Other modifications and variations from the illustrated arrangements will be apparent to those skilled in the art.

What I claim and desire to secure by Letters Patent is:

1. A smoker's pipe comprising a bowl portion defining therein both a tobacco-receiving cavity and, in the lower regions thereof below said tobacco-receiving cavity, a socket, said socket extending transversely of the lower regions of the bowl portion and having an open end and a closed end, the socket having a sidewall tapering inwardly from said open end to said closed end thereof, the bowl portion further defining therein a passageway interconnecting said cavity with said socket, the pipe further comprising a stem portion having a first end region provided with a tapering surface so as to be a close push-fit in the socket of the bowl portion, and an opposed end region for location in a smoker's mouth, the stem portion defining therein a bore extending from the opposed end region thereof to terminate in the tapering surface of the first end region and communicating directly into, to form a continuation of, the passageway in the bowl portion, the pipe having formed therein, below the tobacco-receiving cavity in the bowl portion, a primary reservoir at the closed end of the socket, the pipe further having formed therein, below the tobacco receiving cavity in the bowl portion, a relatively narrow groove extending in a direction away from the bore in the stem portion and the passageway in the bowl portion toward the closed end of the socket and forming a relatively narrow channel providing communication between said bore in said stem portion and said passageway in said bowl portion and the upper regions of said primary reservoir whereby smoke flowing from the bowl portion to the stem portion substantially bypasses said primary reservoir, the dimensions of said primary reservoir being substantially greater than those of said channel the bowl portion and stem portion being rotatable relative to one another about the longitudinal axis of the stem portion between a normal position in which the passageway in the bowl portion forms a continuation of the bore in the stem portion, and a displaced position in which said passageway is disconnected from said bore.

2. A pipe as claimed in claim 1 in which the end extent of the bore within the first end region of the stem portion makes an acute angle with the longitudinal central axis of the stem portion and terminates in the tapering surface of, intermediate the length of, said first end region.

3. A pipe as claimed in claim 2 in which the primary reservoir is formed in the first end region of the stem portion substantially adjacent the end of the bore in the stem portion, said relatively narrow groove being formed in the tapering surface of said first end region of the stem portion and interconnecting said bore with said primary reservoir.

4. A pipe as claimed in claim 2 in which the primary reservoir is formed in the socket of the bowl inwardly of the first end region of the stem portion, the first end region of the stem portion having an end defining part of the bounding surface of the primary reservoir, said relatively narrow groove being formed in the tapering surface of the first end region of the stem portion and interconnecting the bore of the stem portion with said primary reservoir.

5. A pipe as claimed in claim 2 in which said relatively narrow groove is formed in the tapering surface of the first end region of the stem portion, a secondary reservoir also being formed in said tapering surface in said first end region, the bore in the stem portion terminating in said secondary reservoir and said secondary reservoir communicating directly with the passageway in the bowl portion, said groove in the tapering surface of the first end region of the stem portion interconnecting said secondary reservoir with the primary reservoir.

6. A pipe as claimed in claim 1 and including an increased-strength insert at the free end of the opposed end region of the stem portion, said insert surrounding the end extent of the bore in said opposed end region of the stem portion.

7. A pipe as claimed in claim 1 in which the external surface of the stem portion defines thereon at least one peripheral groove adjacent the bowl portion to improve a user's grip on the stem portion while rotating the bowl portion relative thereto.

8. A pipe as claimed in claim 1 in which a series of axially-spaced, peripheral fins are formed externally round the stem portion adjacent the bowl portion to dissipate heat from said portion.

9. A pipe as claimed in claim 1 in which the bowl portion is of wood and at least the opposed end region of the stem portion is of a synthetic resin.

* * * * *